United States Patent [19]

de la Messuziere et al.

[11] 4,198,033

[45] Apr. 15, 1980

[54] SYSTEM FOR TRANSMITTING AND/OR CONTROLLING ROTARY MOTION

[76] Inventors: Philippe de la Messuzière, 30 Zircon Ct., Willowdale, Ontario, Canada, M2H 2A1; Jacques Dulondel, 1081 Saint-Viateur St., Outremont, Québec, Canada, H2V 3W2

[21] Appl. No.: 833,282

[22] Filed: Sep. 14, 1977

[51] Int. Cl.[2] ..... B66D 5/04

[52] U.S. Cl. ..... 254/159; 182/5; 188/72.7; 188/187; 254/157

[58] Field of Search ..... 254/151, 154, 155, 157, 254/158, 159, 160; 182/5, 6, 7, 75; 188/72.7, 85, 187, 188, 290

[56] References Cited

U.S. PATENT DOCUMENTS

| | | | |
|---|---|---|---|
| 605,686 | 6/1898 | Winters | 254/157 |
| 1,593,704 | 7/1926 | Morris | 254/159 X |
| 2,865,475 | 8/1966 | Delaney | 188/290 X |
| 3,265,358 | 12/1958 | MacMillin | 188/187 |
| 3,834,671 | 9/1974 | Du Buisson | 254/158 |
| 4,000,881 | 1/1977 | Matsumoto | 254/157 |
| 4,016,957 | 4/1977 | Osujo et al. | 188/72.7 |
| 4,036,329 | 7/1977 | Anderson | 188/72.7 |

*Primary Examiner*—Edward R. Kazenske

*Assistant Examiner*—Winston H. Douglas

[57] ABSTRACT

The machines of the present invention are adapted to brake a rotor or pulley by the action of centrifugal weights or units which are arranged to produce a reactive braking action on the rotor or pulley. In one application, the machine constitutes a fire escape pulley device including a pulley on which a cable is wound to rotate the pulley under the load of a person suspended by the cable. A rotor bodily rotates with the pulley, a stationary annular cam is arranged around the rotor and defines a radially undulating cam surface facing radially inward toward the rotor, and one or more centrifugally responsive units are radially displaceable on the rotor to be centrifugally biased into rotation reactive engagement with the undulating cam surface. In another application, the machine constitutes a clutch having a rotation input member coaxial with an output member; the input member carries a spider wheel and the output member carries a casing located around the spider wheel; annular cams are fixed within the casing on axially opposite sides of the spider wheel, and centrifugally responsive units are carried by the spider wheel, displaceable radially of the latter, and rollingly engage a pair of cam grooves in the annular cams respectively.

3 Claims, 10 Drawing Figures

SYSTEM FOR TRANSMITTING AND/OR CONTROLLING ROTARY MOTION

This invention relates to a dynamic braking concept and, more particularly, to machines of the type embodying dynamic braking of a rotary component thereof, such as, for instance, in fire escape pulley devices.

Dynamic braking is herein understood as braking of a rotary element when produced in response to the rotational input to this element. Such dynamic braking is most notably used in the above-mentioned fire escape pulley devices to limit the speed of rotation of the pulley and thus of descent of a person hanging to the cable of such devices.

The known above-mentioned fire escape devices produce dynamic braking by camming action of a rotor on movable bodies freely mounted between the rotor and braking segments.

It may be easily understood that the braking force and, therefore, the rotation speed limit is proportional to the weight of the users and may thus very substantially vary beyond a desirable range.

It is a general object of the present invention to provide a dynamically braked machine wherein the braking action is equal to the square of the speed of rotation of the rotary member to be braked and, consequently, the rotation speed limit increases only in accordance with the square root of the increase of the user's weight.

It is another object of the present invention to provide a dynamically braked machine wherein the braking is done by centrifugally responsive units or weights and novel reactive braking on the latter.

It is a more specific object of the present invention to provide centrifugally braked fire escape pulley devices wherein the braking is simply and reliably done as a sole function of the rotation speed by one or more centrifugally responsive units.

It is a further object of the present invention to provide a clutch of simple construction and reliable operation embodying the abovementioned centrifugal braking concept.

In accordance with the invention, there are used both the kinetic and the potential energies of one or more floating masses caused to move back and forth while rotating with their support to obtain progressive rotation of a rotatable envelope containing the masses in the case of a clutch system or to obtain a maximum rotational speed if the envelope is fixed in the case of a braking system.

The above and other objects and advantages of the present invention will be better understood with the following description of preferred embodiments thereof which are illustrated, by way of example, in the accompanying drawings, in which.

Figure 1:
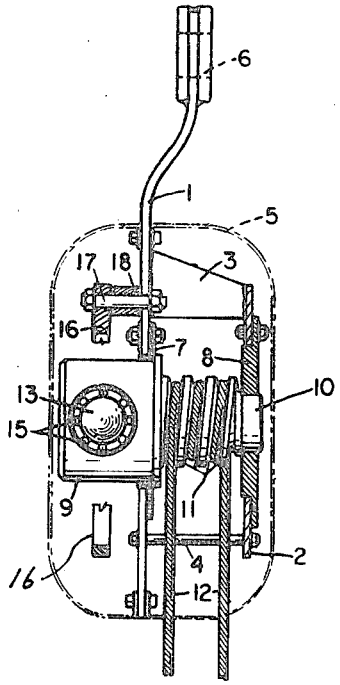
FIG. 1 is a cross-sectional elevation view of a centrifugally braked fire escape pulley device according to a first embodiment of the present invention.
Figure 2:
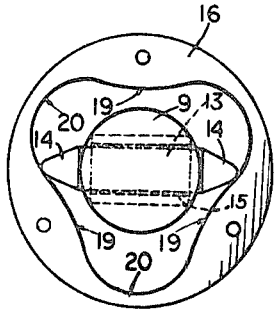
FIG. 2 is a partial side elevational view as seen from the left in FIG. 1.

The centrifugally braked machine illustrated in FIGS. 1 and 2 constitutes a fire escape pulley device including an operatively upright support plate 1 and an auxiliary plate 2 secured to the support plate 1 by a bracket 3 and spacer bolts 4. The upright support plate 1 projects outwardly of the casing 5 for the pulley device and is formed with an aperture 6 at the upper end to hook this device at the top of a window from which it is desired to escape.

A pair of rings 7 and 8 are secured in axially aligned apertures of the plates 1 and 2, respectively. A rotor 9 and a pulley 10 are integrally formed and coaxially arranged end to end with the rotor 9 rotatively carried by the ring 7 and the pulley 10 rotatively carried by the ring 8. The pulley 10 has a helically grooved rim defining a helical groove 11. A fire escape cable 12 is wound in the helical groove 11 with its opposite ends hanging from the pulley 10 and provided with a stirrup or a basket (not shown) at one end to enable a user to descend to ground by unwinding of the cable.

The rotor 9 is formed with a bore extending diametrically therethrough. A cylindrical piston 13 having opposite rounded ends 14 is radially displaceable in the diametrical bore, by means of ball bearings 15 of the type used for linear motion.

An annular cam plate 16 is fixed to the support plate 1 by bolts 17 and spacers 18, such that this cam plate extends in registry with the piston 13 orthogonally to the axis of rotation of the rotor 9. The annular cam plate 16 is formed with a cam surface circumscribing the rotor 9 and facing radially inward toward the rotor. This cam surface radially undulates to form three hill portions 19 separated by three valley portions 20. It must be noted that there is an odd number of hill portions and, of course, of valley portions such as to have a hill portion in diametrical alignment with a valley portion, as seen in FIG. 2, and to have substantially the same diametrical spacing between any two diametrical points of the cam surface properly corrected to take into account the radius of curvature at both ends 14 of piston 13, such that the opposite ends 14 of the piston 13 remain in contact with the cam surface at all times. Also, it must be noted that, as one end 14 moves up a hill portion 19, the opposite end 14 moves down a valley portion 20.

As an alternative, the piston could be made of two telescopic spring-loaded parts, in which case the spacing between any two diametrical points of the cam surface could be made exactly constant.

When a person hangs to one end of the cable 12, the pulley 10 and the rotor 9 are rotatably driven by the cable. As a result, the centrifugal action causes the piston 14 to radially move toward a valley portion. When one end of the piston moves radially into a valley portion, the center of gravity of the piston becomes radially spaced from the axis of the rotor toward the corresponding valley portion. Then, as the same end of the piston moves along the radially inward camming portion of the following hill portion, the cam plate 16 produces a rotation reactive action against the piston in opposition to the centrifugal action of the piston and there results a braking effect on the rotor and piston assembly. It will be easily understood that this rotation reactive action is proportional to the centrifugal action on the piston and, thus, to the square of the angular velocity or speed of the pulley and rotor assembly. Consequently, the braking increases with the square of the speed of rotation and adequate to impose a maximum speed of rotation to the pulley 10 and maximum speed of descent of a person hanging to the cable.

Figure 3:
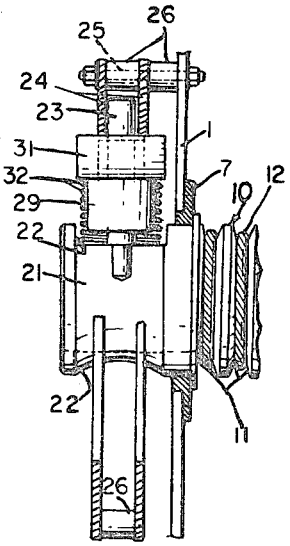
FIG. 3 is a cross-section of a centrifugally braked fire escape pulley device according to a second embodiment of the present invention and taken along section line A—A of FIG. 4.
Figure 4:
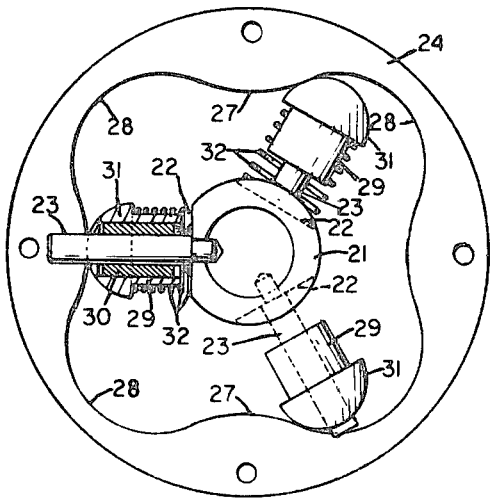
FIG. 4 is an end view of the pulley device of FIG. 3 as seen from the left in the latter figure.

The centrifugally braked machine of FIGS. 3 and 4 also constitutes a fire escape pulley device including the elements 1, 2, 3, 4, 5, 6, 7, 8, 10, 11, and 12, as afore described with references to FIGS. 1 and 2.

In this fire escape pulley device, a rotor 21 is fixed axially endwise to the pulley 10 for rotation therewith. The rotor 21 is formed with three cylindrical seats 22 with a flat bottom, bored therein at 120° apart around the circumference of the rotor. A guide pin 23 is screwed in the rotor 21 coaxially of each cylindrical seat 22 to radially project from the rotor.

A pair of annular cam plates 24 are fixedly secured to the support plate 1 by means of bolts 25 and tubular spacers 26, such that these cam plates extend in parallel spaced-apart relationship on opposite sides respectively of the three guide pins 23. The annular cam plates 24 are made as the cam plate 16, except that they have each four hill portions 27 separated by four valley portions 28. It should be noted that in this fire escape pulley device, there is no need to have an odd number of hill or valley portions nor to have the same diametrical spacing between any two diametrically opposite points of the radially undulating cam surface due to the different piston arrangement which is used in this embodiment.

A tubular piston 29 is slidably mounted on each guide pin 23 by means of a brass bushing 30. Each piston 29 is formed with a semicylindrical head 31 engaging the cam surface of the two annular cam plates 24. The head 31 is at its base larger than the shank portion of the piston for engagement of a spring 32 around the shank portion of each piston 29 in compression between the corresponding heat 31 and seat 22.

The operation of this fire escape pulley device of FIGS. 3 and 4 is the same as the operation of the first described pulley device, except that each piston 29 independently operates and is subjected to the fixed spring action in addition to the centrifugal action. However, in this case also, the rotation reactive action of the cam plates is a sole function of the speed of rotation of the pulley and rotor assembly.

Figure 5:
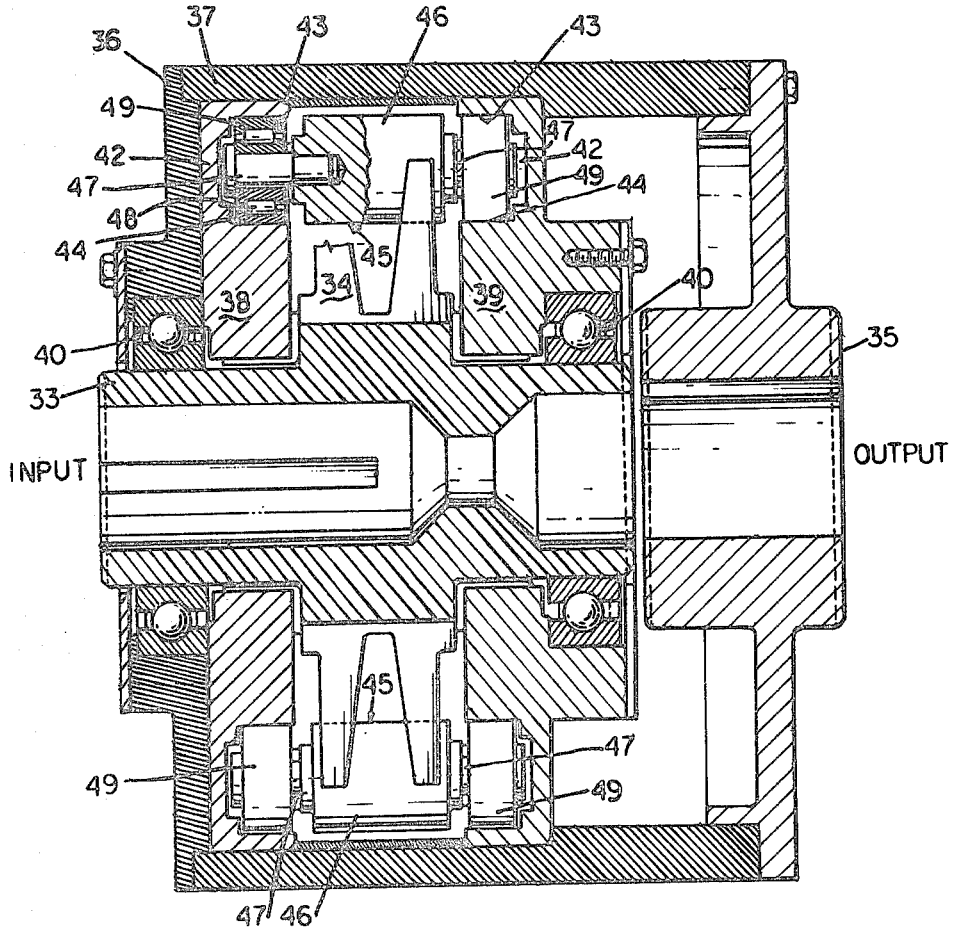
FIG. 5 is an axial section through a clutch according to a third embodiment of the present invention.
Figure 7:
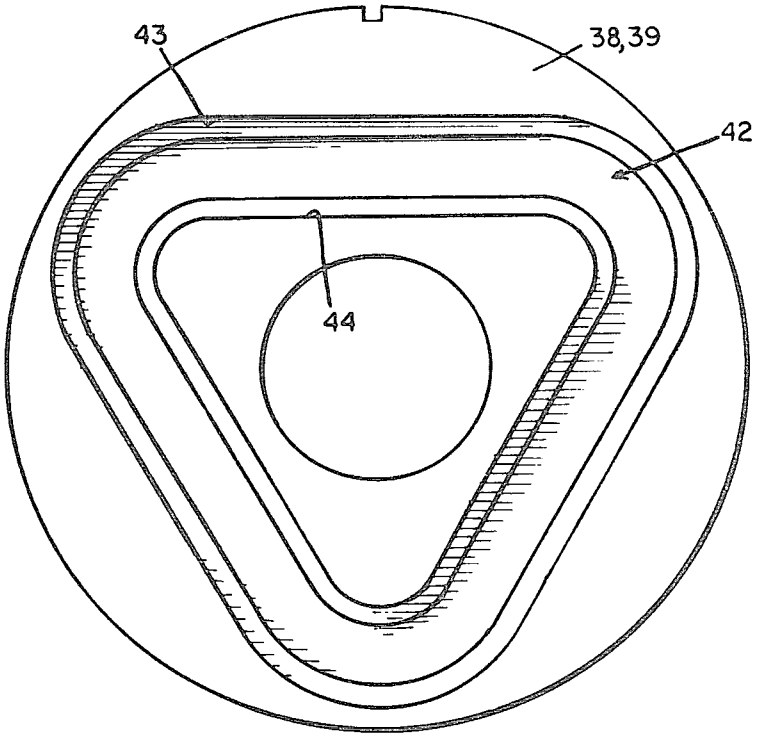
FIG. 7 is a front elevation of an annular cam member used in the clutch of FIG. 5.
Figure 6:
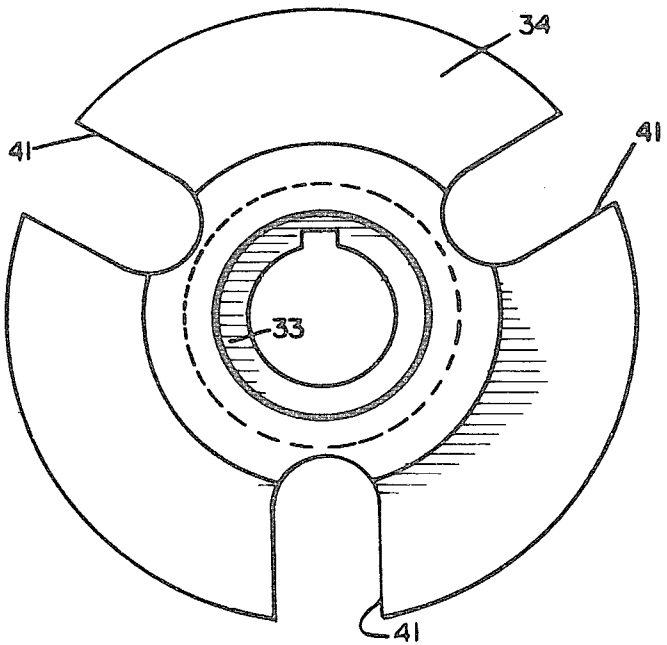
FIG. 6 is a front elevation of a spider wheel used in the clutch of FIG. 5.

The centrifugally braked machine illustrated in FIGS. 5, 6, and 7 constitutes a clutch drive. This clutch drive includes a rotation input member 33 having an integral spider wheel 34 for rotation therewith. A rotation output member 35 is mounted coaxially of the rotation input member 33; is fixed to and cooperates with an annular end plate 36 and a cylindrical body 37 to form a casing around the spider wheel 34. A pair of annular cam plates 38 and 39 are fixedly secured in the abovementioned casing for bodily rotation therewith. Ball bearing 40 rotatably support this casing and cam plates for rotation thereof relative to the rotation input member 33.

The spider wheel 34 is formed with three radial slots 41 at 120° apart around the circumference thereof. Each annular cam plate 38 and 39 is formed with a groove 42 of triangular configuration extending around the axis of rotation of the described casing. Each triangular groove 42 is formed with parallel cam surfaces 43 and 44 facing radially inward and outward respectively. The two annular cam plates 38 and 39 are positioned on axially opposite sides respectively of the spider wheel 34 with the triangular grooves 42 mutually facing each other and in exact angular registry around the axis of rotation.

In each radial slot of the spider wheel 34, there is mounted a centrifugally responsive unit 45. Each of these centrifugally responsive unit 45 includes a central cylindrical body 46 extending lengthwise transversely of the spider wheel. A stud axle 47 is screwed into each end of the central body 47 and projects coaxially with the latter. A ball bearing 48 is mounted on each stud axle 47 and includes an outer race 49 for rolling engagement with the cam surface 43 or 44.

When the rotation input member 33 starts to rotate, the centrifugal action on the centrifugally responsive units 45 urges the latter radially outwardly in the radial slots 41 with the rollers 49 engaging against the cam surfaces 43. These units 45 then roll along the surfaces 43 and are thus moved in a back-and-forth radial movement. The resultant reaction on the cam surfaces causes progressive acceleration of the output member 35. When sufficient speed of the input member 33 is attained in relation to the load at the output, units 45 become centrifugally locked in the respective apex portions of the triangular grooves 42. In this position, as shown in FIG. 7, the clutching operation is completed and the units 45 fully transmit the rotation of the member 33 to the rotation output member 35.

It is to be noted that the resulting clutch is frictionless. Several spider wheels and associated parts can be spacedly arranged axially of the input member, and the number of cams accordingly increased to take care of larger loads.

Figure 8:
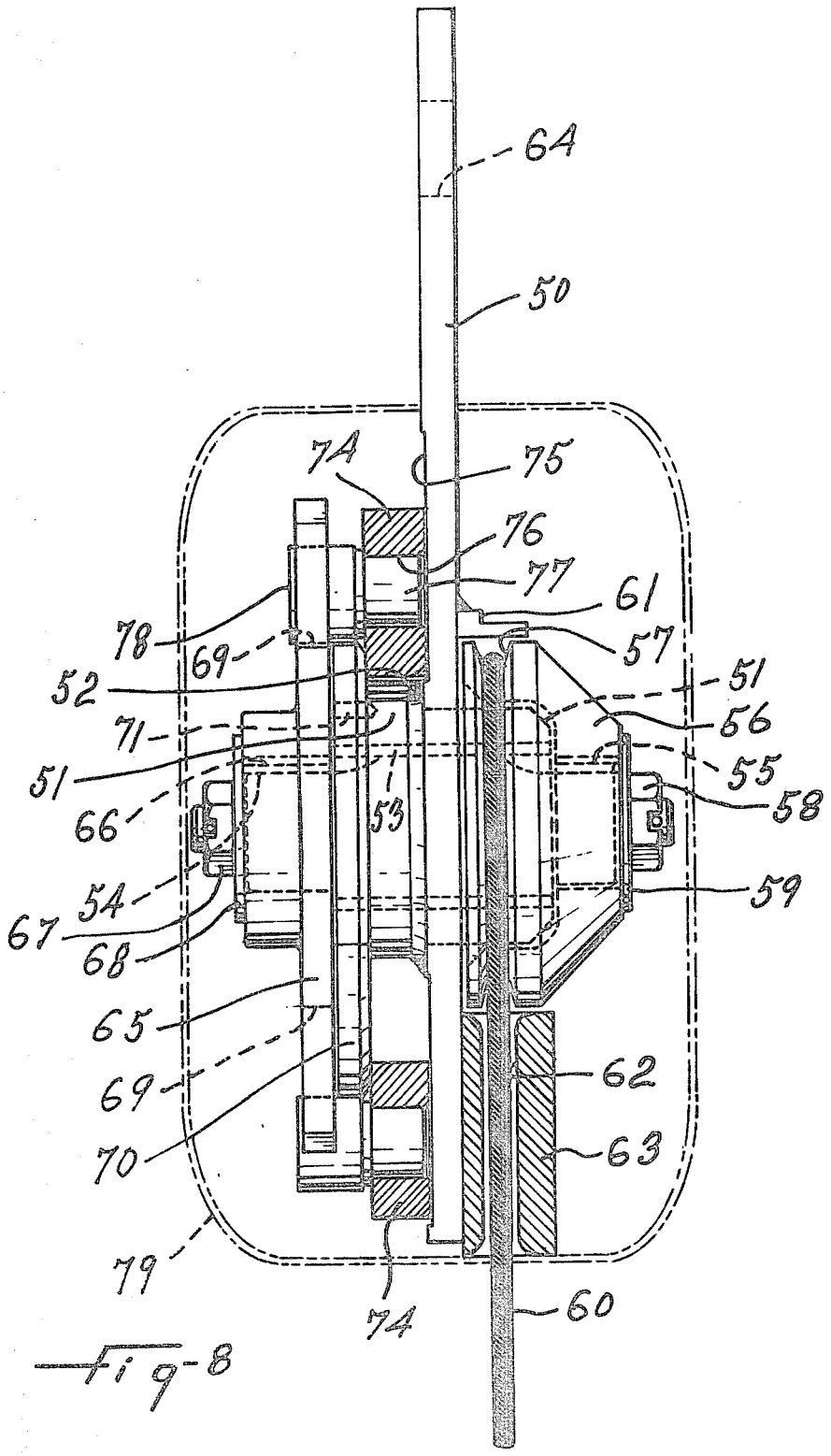
FIG. 8 is a side elevation, partly in cross-section, of a fourth embodiment in accordance with the present invention showing a fire escape pulley device.
Figure 9:
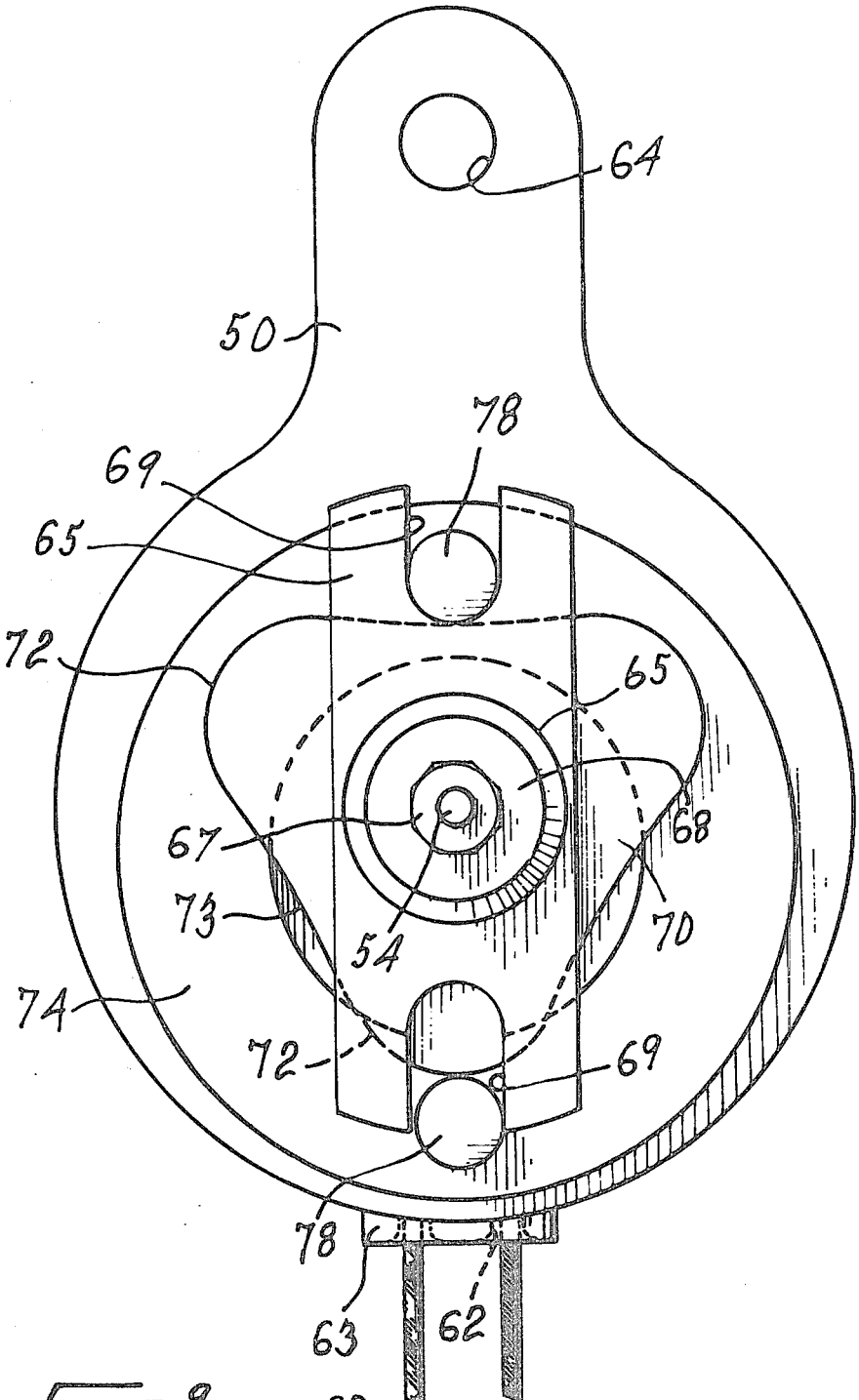
FIG. 9 is a side elevational view as seen from the left of FIG. 8.
Figure 10:
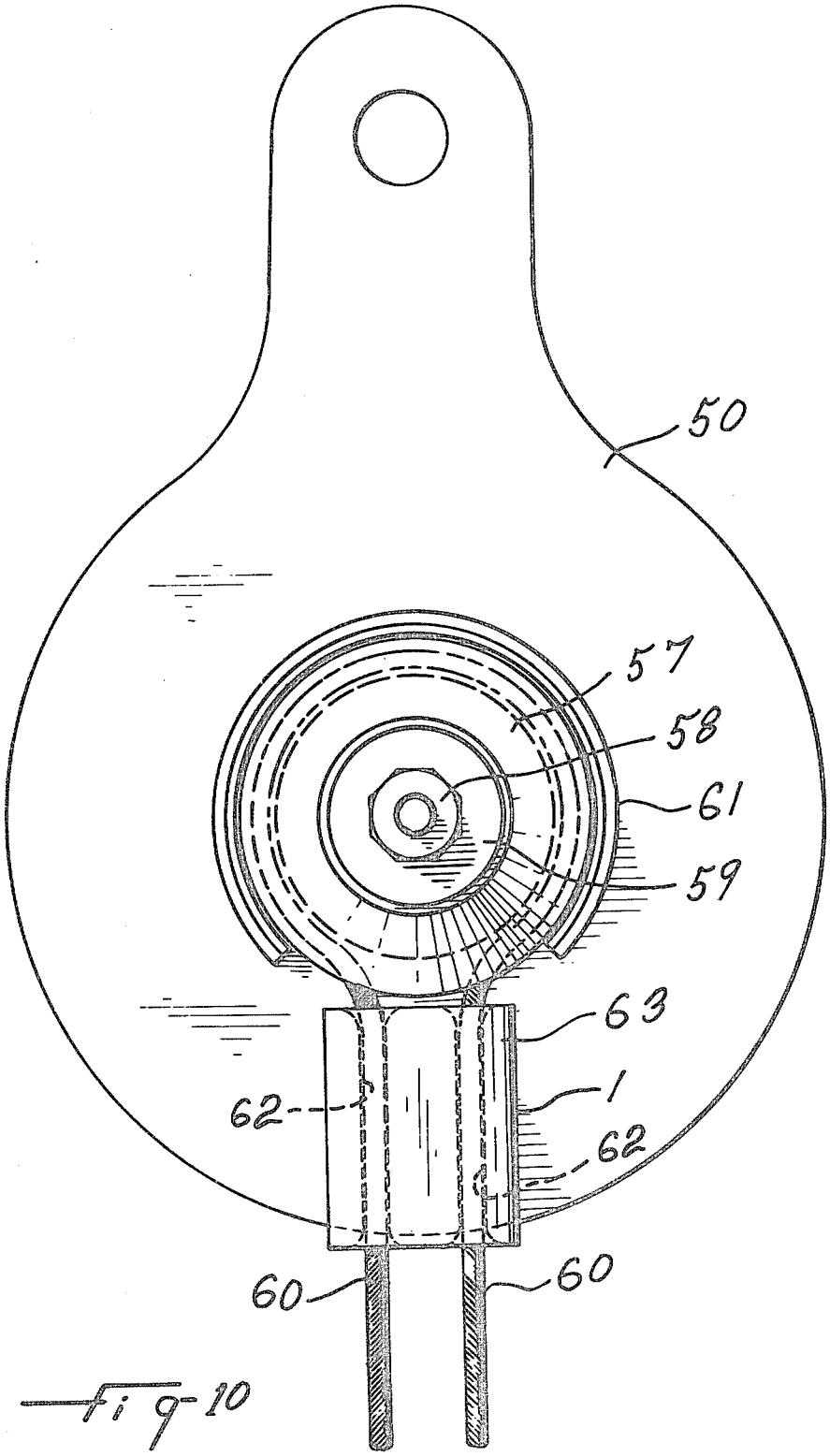
FIG. 10 is a side elevational view as seen from the right of FIG. 8.

FIGS. 8, 9, and 10 show another embodiment of a fire escape pulley device in accordance with the invention. This pulley device includes an operatively upright support plate 50, through a central hole of which extends a sleeve 51 secured to the plate 50, for instance by welding 52. Sleeve 51 is fitted with a bronze bushing 53 in which is journalled a rotor, or shaft 54, protruding from both ends of the sleeve 51. On one of the shaft is keyed by key 55 a pulley 56 having a single V-shaped circumferential groove 57. The pulley 56 is maintained on the shaft 54 by nut 58 and washer 59. A cable 60 is trained in the groove 57 of pulley 56 and is retained therein by means of partially circular guard 61 secured to the plate 50. The two strands of cable 60 further extend through guiding bores 62 of a block 63 secured to the plate 50 below the pulley 56.

It will be noted, as shown in FIG. 10, that the two guiding bores 62 are closer together than the diameter of the pulley, so as to maintain the cable in engagement with the groove 57 over the major part of the circumferential extend of said groove to prevent slipping of the cable within the groove.

As shown in FIG. 8, the pulley 56 overhangs the sleeve 51 to provide a maximum bearing length for the rotor 54, while permitting to secure guard 61 and block 63 directly to plate 50. The top end of the plate 50 is provided with a hole 64, as in the previous embodiments, to suspend the pulley device from the top of a window, or the like. One end of the cable 60 is fitted with a stirrup, or basket, not shown, to enable a user to descend to ground by unwinding of the cable.

A rectangular spider plate 65 is secured by a key 66 to the opposite end of the shaft 54 and is retained on said shaft by means of nut 67 and washer 68. The spider plate 65 is formed with diametrically opposed outwardly opening notches 69.

A cam plate 70 is secured to the end of sleeve 51 immediately inwardly of spider plate 65 by means of one or more pins 71, or the like. This cam plate is of generally triangular form, as shown in FIG. 9, providing an outwardly directed cam edge forming three hill 72 with three intervening valleys 73. The distance between any diametrically opposite zones of the cam edge is substantially constant throughout the periphery of the cam plate.

A flat ring 74 is applied for free slidable movement both in rotation and in radial movement against a recessed surface portion 75 of the suspension plate 50. This ring is retained against surface portion 75 by cam plate 70 and is bored through two diametrically opposed portions, as shown at 76, to receive with a press-fit a stub shaft 77, each carrying a follower roller 78 located within the corresponding notch 69 of the spider plate 65. The entire mechanism is housed in a casing 79, shown in dotted line in FIG. 8. The follower rollers 78 are in rolling engagement with the cam edge of the cam plate 70. The distance between the rollers 78 is such that these rollers are in constant rolling engagement with the cam edge of cam plate 70.

It will be understood that rotation of shaft 54 under the weight of a user suspended from one stand of cable 60 causes spider plate 65 to rotate the rollers 78 and flat ring 74 about the rotational axis of the device and, at the same time, the flat ring will reciprocate radially due to the riding of the follower rollers on the cam edge of the cam plate 70.

The flat ring 74 is subjected to a centrifugal force in all of its positions eccentric to the rotational axis which must be overcome by the cam edge to return the ring to a coaxial position with consequent braking of the shaft, as previously described.

Tests have shown that the increase of the speed of the descending user can be made very limited with an increase of the load suspended from cable 60, since the braking action is proportional to the square of the amplitude of the back-and-forth movement of ring 74.

What we claim is:

1. An apparatus for lowering a load comprising a support, a shaft journalled in said support, a pulley secured to said support, a cable trained on said pulley and rotation said pulley and shaft under a load attached to said cable and being lowered, and means for retarding rotation of said shaft under the action of said load, said retarding means comprising a cam secured to said support, circumscribing said shaft and defining a continuous undulated cam surface substantially parallel to the rotational axis of said shaft and having a minimum of three first portions radially equally spaced from said rotational axis and separated by a minimum of three second portions radially equally spaced from said rotational axis, said first portions being closer to said rotational axis than said second portions, each first portion being diametrically opposed to one of said second portions with respect to said rotational axis, a weight driven in rotation by said shaft and capable of radial movement relative to said shaft and carrying two cam follower portions diametrically opposed relative to said shaft and in continuous engagement with said cam surface whereby rotation of said weight by said shaft causes a minimum of three cycles of radial back and forth movement of said weight relative to said shaft for each complete rotation of said shaft, the force required to produce acceleration and deceleration of said weight during said radial back and forth movement being sufficient to cause significant retarding of said shaft rotation.

2. An apparatus as claimed in claim 1, wherein said weight is a ring freely surrounding said shaft, said cam followers protruding laterally from said ring and a spider wheel secured to said shaft and having radial slots each receiving a cam follower to cause rotation of said ring by said shaft.

3. An apparatus as claimed in claim 2, wherein each cam follower includes a stud shaft secured to said ring and a roller rotatably mounted on said stud shaft and in rolling engagement with said cam surface.

* * * * *